US006547297B2

(12) United States Patent
Cote et al.

(10) Patent No.: US 6,547,297 B2
(45) Date of Patent: Apr. 15, 2003

(54) GRIPPER ASSEMBLY FOR A MATCHED VELOCITY TRANSFER DEVICE

(75) Inventors: Kevin Lauren Cote, Durham, NH (US); Richard Daniel Curley, Dover, NH (US); Joseph Adrian St. Ours, Lee, NH (US)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 10/235,072

(22) Filed: Sep. 5, 2002

(65) Prior Publication Data

US 2003/0042747 A1 Mar. 6, 2003

Related U.S. Application Data

(62) Division of application No. 09/941,956, filed on Aug. 28, 2001.

(51) Int. Cl.[7] ..... B65H 5/14

(52) U.S. Cl. ..... 294/104; 294/116; 271/82

(58) Field of Search ..... 294/103.1, 104, 294/106, 116; 271/69, 314, 82, 268, 277, 184, 187, 270

(56) References Cited

U.S. PATENT DOCUMENTS

| | | | | |
|---|---|---|---|---|
| 4,629,175 A | | 12/1986 | Fischer et al. | 271/277 |
| 5,452,886 A | | 9/1995 | Cote et al. | 83/23 |
| 5,560,599 A | * | 10/1996 | Curley et al. | 271/270 |
| 5,855,153 A | | 1/1999 | Cote et al. | 271/270 |
| 5,927,712 A | | 7/1999 | Curley et al. | 271/202 |
| 6,357,741 B1 | * | 3/2002 | Cassoni | 271/206 |
| 6,419,223 B1 | * | 7/2002 | Sting et al. | 271/268 |

* cited by examiner

*Primary Examiner*—Dean J. Kramer
(74) *Attorney, Agent, or Firm*—Laurence A. Greenberg; Werner H. Stemer; Ralph E. Locher

(57) ABSTRACT

A gripper assembly for a deceleration/acceleration drum is described which includes a pivot arm with a gripper seat and a gripper bar with a gripper and a pin assembly. The assembly further includes a first toggle link supported by the pivot arm about a first pivot points the gripper bar is able to partially rotate about the first toggle link about a second pivot point. The assembly also includes a second toggle link supported by the pivot arm which supports the pin assembly of the gripper bar.

10 Claims, 8 Drawing Sheets

GRIPPER ASSEMBLY FOR A MATCHED VELOCITY TRANSFER DEVICE

CROSS-REFERENCE TO RELATED APPLICATION

This is a division of U.S. application Ser. No. 09/941,956, filed Aug. 28, 2001.

BACKGROUND OF THE INVENTION

FIELD OF THE INVENTION

The present invention relates to a gripper assembly for a matched velocity transfer device for printing equipment, particularly for folding machines and former modules of a printing system.

Fan wheels are commonly used for gripping and transporting signatures within a folding machine. The curved shape and jagged surface of fan blades forming the fan wheel slow the forward movement of the signatures being deposited. Fan wheel pockets formed by adjacent blades receive the signatures exiting a folding device. A drawback of such devices is that the signatures can be torn or damaged by the wheel pockets because the signatures enter the wheel pockets at a high velocity.

U.S. Pat. No. 4,629,175 discloses a device for overcoming these problems. The device contains rows of grippers rotating between a supply device and a downstream delivery system. The grippers are mounted to a cylindrical drum rotating at a constant speed, and the rows of grippers are accelerated by a drive to be synchronized to that of the supply device and then decelerated to the speed of the delivery system. However, signatures can be damaged due to the fact that the grippers are rotated into a position in front of a leading edge of the signature being delivered by the supply device. This occurs because the velocity of the signature on the supply device must be greater than a tangential velocity of the gripper. The signature, moving quicker than the gripper, enters into the gripper and the gripper closes on the signature. The leading edge of the gripper immediately slows to the speed of the gripper. However, the trailing edge of the signature is under control of the supply device and is therefore traveling at a higher velocity than that of the leading edge. Therefore, the signature may be damaged by the differences in the velocities.

U.S. Pat. No. 5,452,886 discloses a deceleration drum for slowing down signatures being transported in a folding machine. The drum contains a plurality of pivot arms connected to a rotating pivot disc and allowed to pivot independently of each other. A control link is connected to each pivot arm and to a rotating control disc. The rotating control disc allows for the acceleration and the deceleration of a signature. A gripper disposed on the pivot arm receives the signature as the signature enters the deceleration drum. The system is preferably timed so that the leading edge of the incoming signature is gripped by the gripper head before the trailing edge of the signature is released by a tape conveyor system. It is noted here once again that the signature is accelerated into the gripper and that the signature is pulled by the gripper while still held by the conveyor system. Therefore, the signature can be damaged during the handoff.

SUMMARY OF THE INVENTION

It is accordingly an object of the invention to provide a gripper assembly for a matched velocity transfer device that overcomes the above-mentioned disadvantages of the prior art methods and devices of this general type, in which after the transfer of the signature from a transport system to a gripper system, no instantaneous change in the speed of the gripper is necessary.

With the foregoing and other objects in view there is provided, in accordance with the invention, a method for transferring signatures. The method includes moving a gripper assembly containing a gripper bar having a gripper and a pivot arm having a gripper seat such that the gripper projects through a space in front of a leading edge of a signature being delivered on a transport system. The gripper assembly is further moved such that the gripper seat is directly aligned with the leading edge of the signature and the gripper seat is traveling at a same velocity as the signature. The gripper is driven in a direction of the gripper seat such that the signature is held between the gripper and the gripper seat. In this manner, when the gripper assembly grips the signature, the gripper and the signature have the same velocity and therefore, the signature is less likely to be damaged during the handoff.

In accordance with an added mode of the invention, there is the step of moving the gripper bar towards the pivot arm such that the gripper is positioned above the leading edge of the signature before performing the driving step. In addition, the gripper assembly moves in the same direction as the signature. Then the signature is removed from the transport system. The signature can be decelerated after the signature is removed from the transport system.

In accordance with an additional mode of the invention, the moving and further moving steps are performed by rotationally moving the gripper assembly about a pivot point. In accordance with another mode of the invention, the gripper assembly has a pin assembly connected to the gripper bar and a cam guides a path of the pin assembly. The cam controls the pin assembly which in turn controls the driving of the gripper toward the gripper seat and for rotationally moving the gripper bar towards the pivot arm.

In accordance with a further mode of the invention, the gripper seat is aligned with the signature before the leading edge of the signature leaves the confines of the transport system.

In accordance with a concomitant mode of the invention, the signature is initially clamped between the gripper and the gripper seat such that the velocity of the signature is not changed due to the clamping action by the gripper and the gripper seat. The clamping of the signature between the gripper and the gripper seat is done such that the signature, the gripper and the gripper seat are moving in a same direction and at the same velocity.

With the foregoing and other objects in view there is further provided, in accordance with the invention, a gripper assembly for a deceleration/acceleration drum. The gripper assembly contains a pivot arm having at least one gripper seat and a gripper bar having at least one gripper and a pin assembly. A first toggle link is supported by the pivot arm about a first pivot point. The gripper bar is able to partially rotate about the first toggle link about a second pivot point. A second toggle link is supported by the pivot arm and supports the pin assembly of the gripper bar. A cam having a contoured path is provided. The pin assembly extends into and is guided by the contoured path. A rotation of the cam causes a movement of the pin assembly such that the gripper moves one of towards and away from the gripper seat due to the rotation of the cam. While the gripper seat is being moved such that the gripper seat is directly aligned with a leading edge of a signature and is traveling at a same velocity as the signature, the cam starts driving the gripper in a direction of the gripper seat such that the signature is eventually held between the gripper and the gripper seat without changing a velocity of the signature.

In accordance with an added feature of the invention, a cam follower drives a rotation of the cam.

In accordance with an additional feature of the invention, the pin assembly through the cam moves the gripper bar in a rotational direction around the second pivot point such that the gripper bar moves one of towards and away from the pivot arm.

In accordance with another feature of the invention, the pin assembly is supported by the second toggle link.

In accordance with a further feature of the invention, the first toggle link has a section in the shape of a cylinder and the gripper bar is able to rotate about the section. This allows the gripper bar to close in on the pivot arm under the influence of the cam.

In accordance with another added feature of the invention, the pivot arm has holes and the first toggle link has pins that can rotate in the holes of the pivot arm.

In accordance with another additional feature of the invention, the pivot arm has a channel receiving the pin assembly.

In accordance with a further added feature of the invention, the contoured path has an irregular sinusoidal shape.

In accordance with a concomitant feature of the invention, the second toggle link has a pin and the pin assembly has a hole formed therein receiving the pin of the second toggle link and the pin assembly can rotate about the pin.

Other features which are considered as characteristic for the invention are set forth in the appended claims.

Although the invention is illustrated and described herein as embodied in a gripper assembly for a matched velocity transfer device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
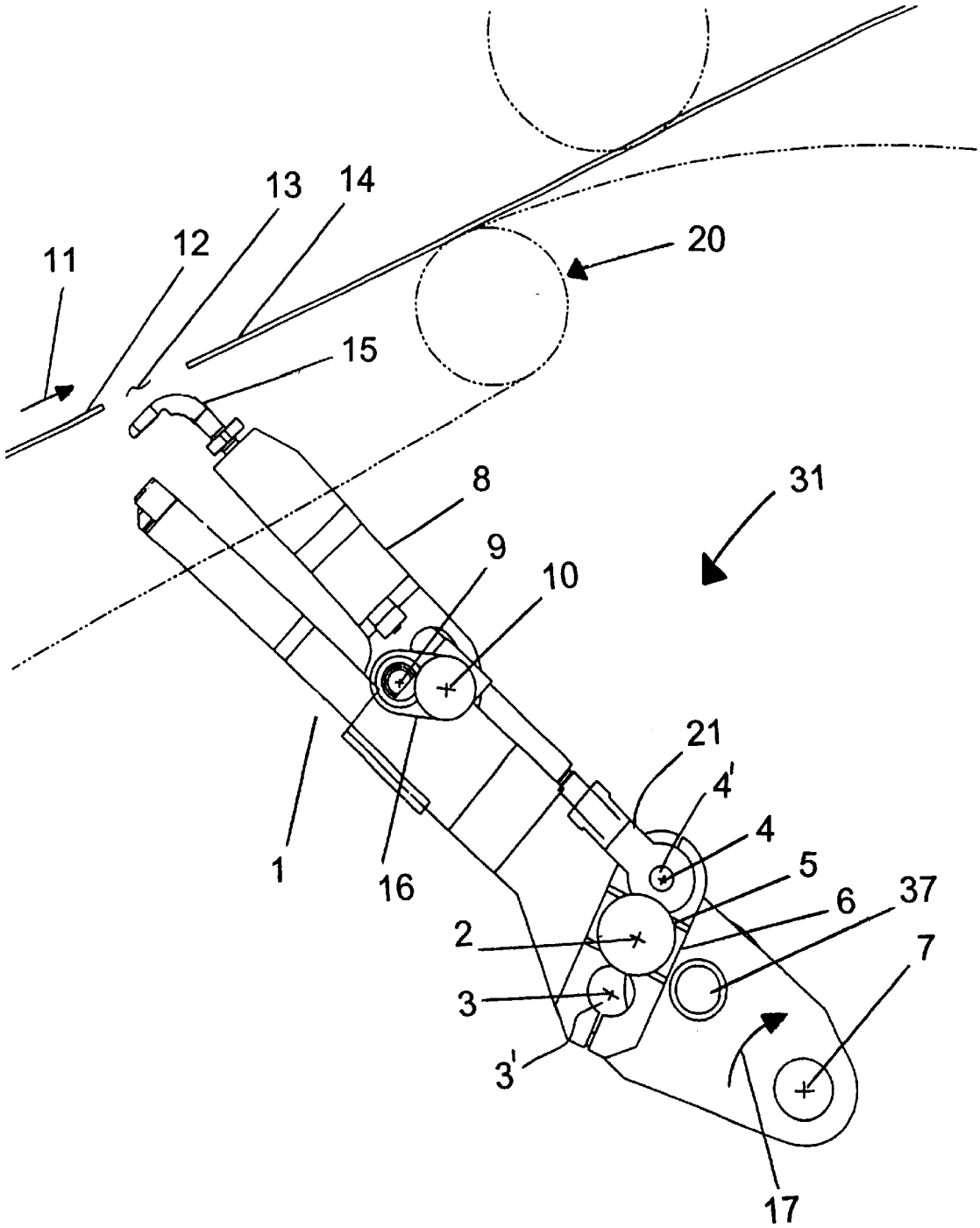
FIG. 1 is a diagrammatic, simplified illustration of a gripper assembly according to the invention.

In all the figures of the drawing, sub-features and integral parts that correspond to one another bear the same reference symbol in each case. Referring now to the figures of the drawing in detail and first, particularly, to FIG. 1 thereof, there is shown a gripper assembly 31 formed of a pivot arm 1 rotating about a pivot point 7 in a direction shown by an arrow 17. A gripper bar 8 is supported on an upper toggle link 16 and can partially rotate about a pivot point 9. The upper toggle link 16 is in turn supported by the pivot arm 1 about a pivot point 10. The gripper bar 8 is also connected to a lower toggle link 6 at a pivot point 4 via a pin assembly 21 of the gripper bar 8. The pin assembly 21 rotates about a pin 4' extending from the lower toggle link 6. The lower toggle link 6 in turn is supported by the pivot arm 1 about a pivot point 3. The lower toggle link 6 rotates about a pin 3' extending from the pivot arm 1.

A gripper 15 is rigidly attached to one end of the gripper bar 8. A gripper seat 18 is rigidly mounted to the pivot arm 1. A cam follower 5 is supported by the lower toggle link 6 about a pivot point 2. A position of the cam follower 5 dictates a position of the gripper bar 8 and thus a position of the gripper 15 relative to the pivot arm 1.

In FIG. 1, the gripper 15 is shown just below a space 13 between a trailing edge of a signature 14 and a leading edge of a next signature 12. The signatures 12, 14 are travelling in a direction shown by an arrow 11. A position of the pivot arm 1 is controlled by the rotation of the pivot arm 1 about the pivot point 7. The signatures 12, 14 are transported on a tape system 20 and are transferred to the gripper assembly 31.

Figure 2:
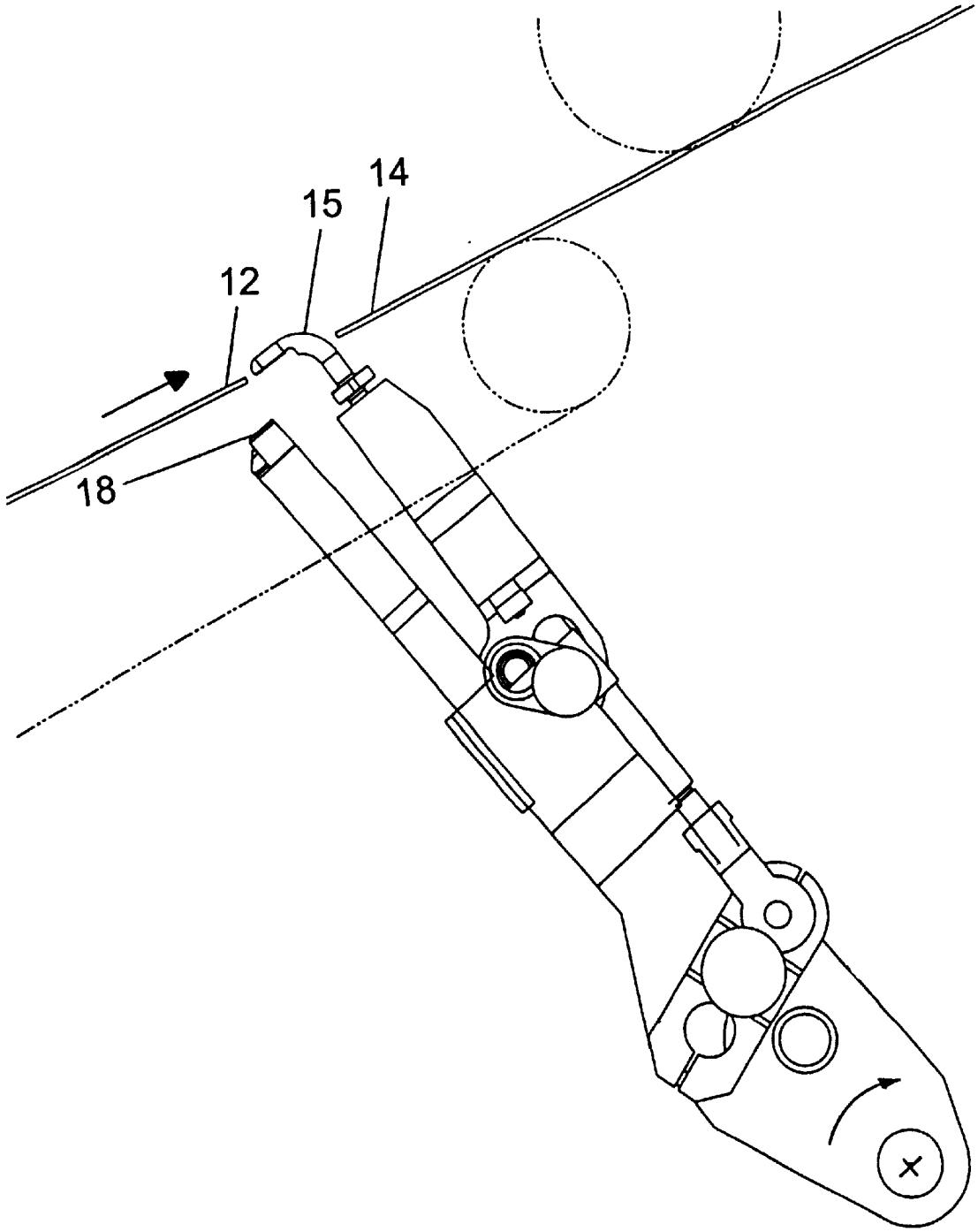
FIG. 2 is an illustration of a gripper projecting between signatures.

In FIG. 2 the gripper 15 projects through the space 13 between the trailing edge and the leading edge of the signatures 12, 14. This is due to a further rotation of the pivot arm 1.

Figure 3:
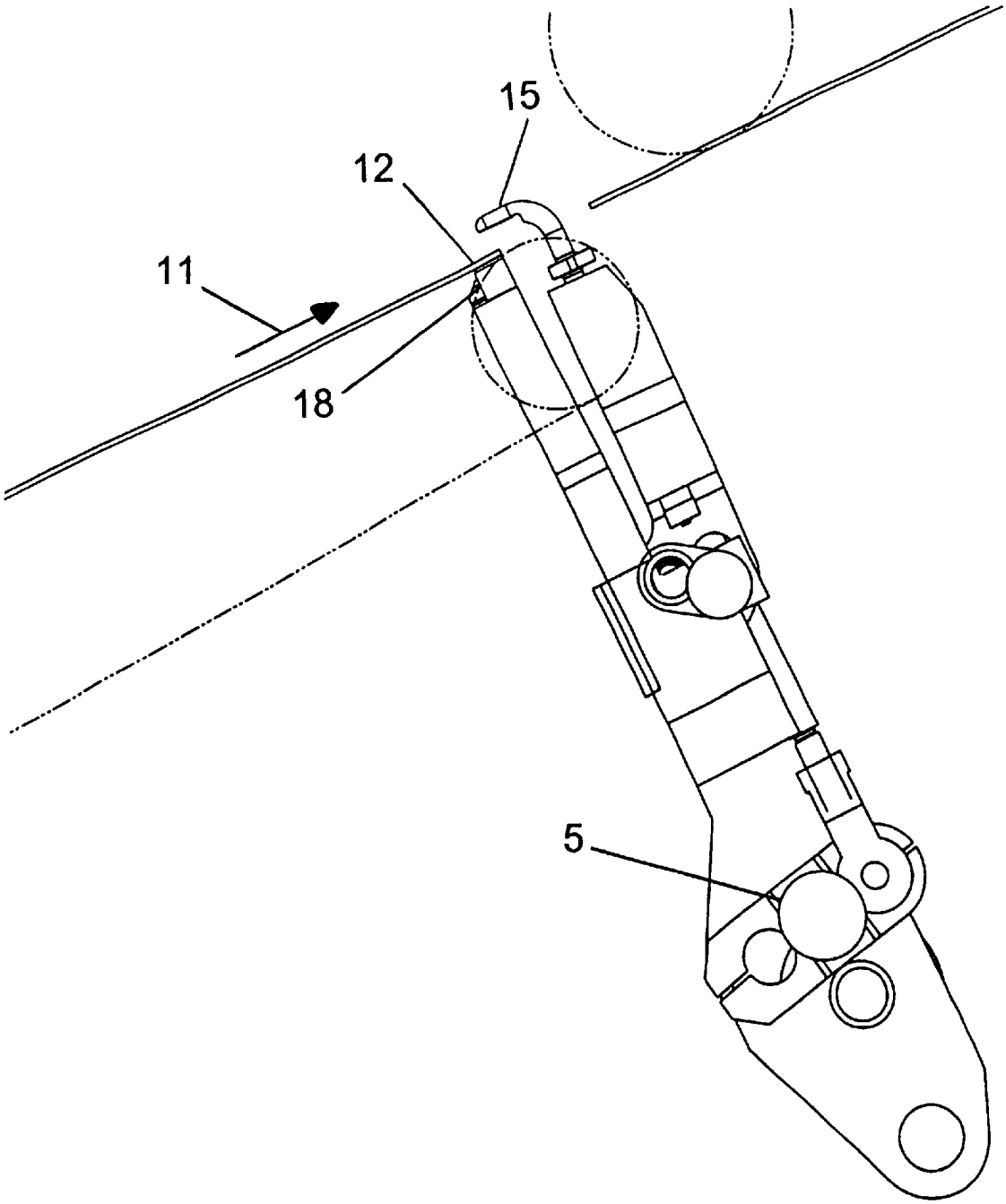
FIG. 3 is an illustration of the gripper closing in on a signature.

FIG. 3 shows the progression continuing to the position where the pivot arm 1 has rotated such that the gripper seat 18 is directly aligned with the leading edge of the signature 12. Both the signature 12 and the gripper seat 18 are travelling in the same direction and at the same velocity at the position shown in FIG. 3. In addition, the gripper 15 has started to close as dictated by the position of the cam follower 5.

Figure 4:
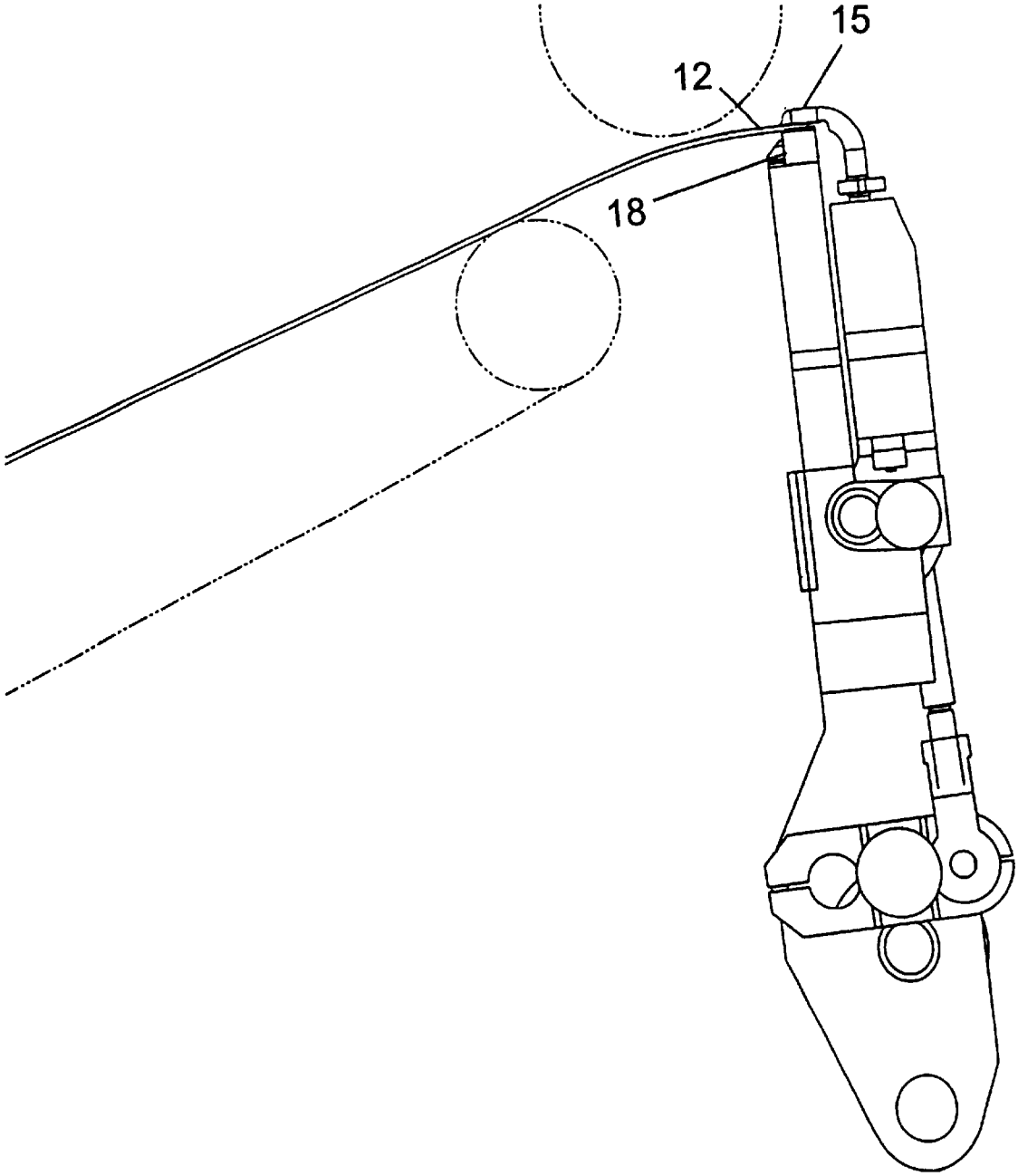
FIG. 4 is an illustration of the gripper clamping the signature.

In FIG. 4, the pivot arm 1 is traveling at the same velocity as the signature 12 while the gripper 15 finishes closing on the signature 12 gripping the signature 12 against the gripper seat 18. In this manner, the signature 12 is removed from the tape system 20 and is further transported. It is noted that there is no instantaneous change in the speed of the gripper 15 after the signature 12 is gripped and the signature 12 is further transported without the undesirable effects known from the prior art. It is further noted that the gripper 15 does not "flip" through the edge of the signature in order to grip it on a return stroke and therefore is less likely to damage is the signature 12.

It is noted that FIGS. 1–4 are in a highly diagrammatic format. FIGS. 5–8 provide more specific detail of the invention.

Figure 5:
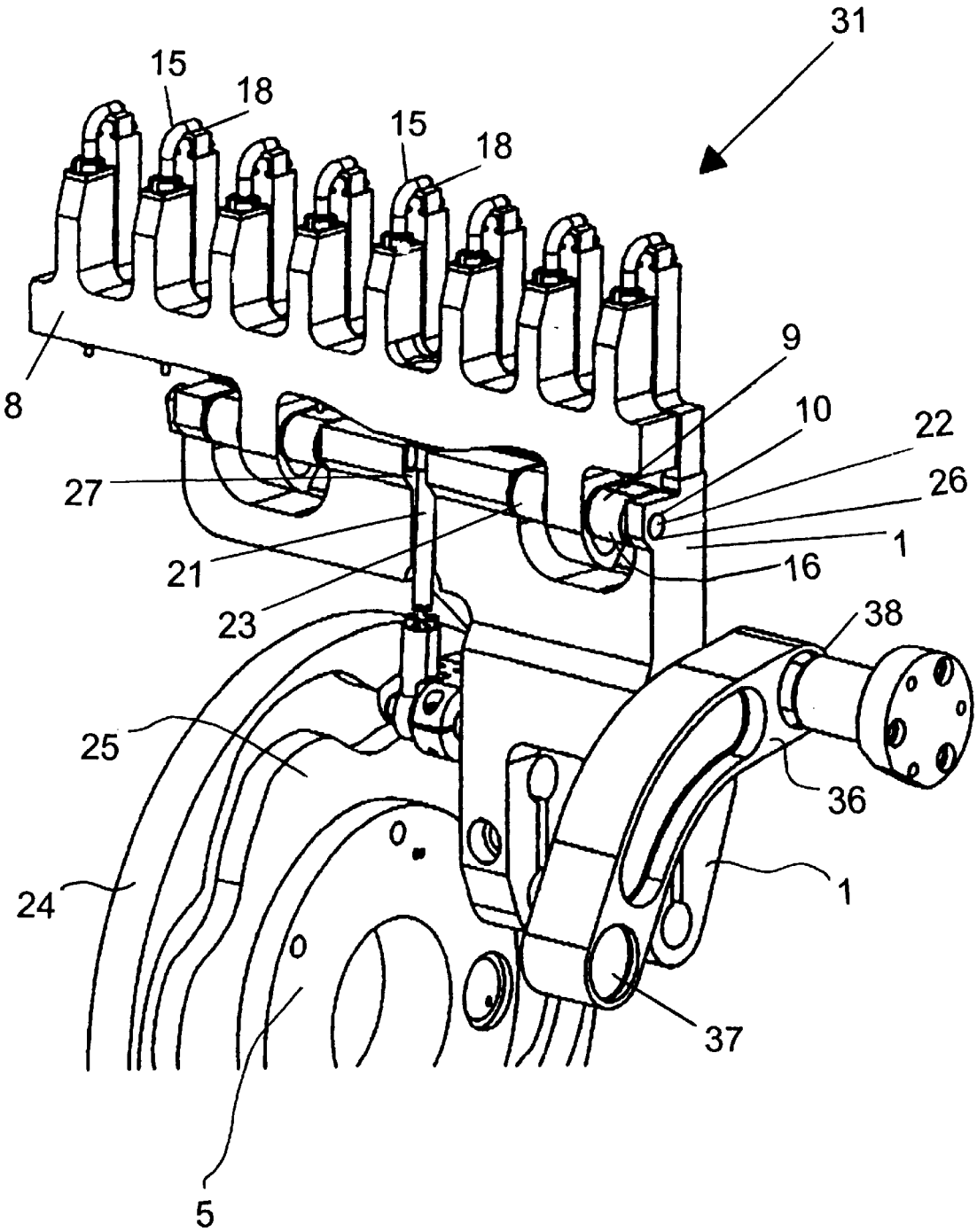
FIG. 5 is a detailed perspective view of parts of the gripper assembly.

FIG. 5 shows a perspective view of the gripper assembly 31 in which the gripper bar 8 is shown with a plurality of the grippers 15 and the pivot arm 1 has a plurality of the gripper seats 18. The upper toggle link 16 has a pin 22 that rotates in a hole 26 formed in the pivot arm 1 and defines the pivot point 10. The upper toggle link 16 also has a cylindrical section 23 about which the gripper bar 8 rotates and defines the pivot point 9. It is noted that the gripper bar 8 can move rotationally about the pivot point 9 and vertically as there is an open space between the bottom of the upper toggle link 16 and the gripper bar 8. The cam follower 5 rotates a cam 24 that has a contoured or grooved path 25 formed therein. The pin assembly 21 of the gripper bar 8 follows the contour of the grooved path 25 as the cam follower 5 rotates the cam 24. Due to the change in height and the change in course of the grooved path 25, the gripper bar 8 moves both up and down and angularly towards or away from the pivot arm 1. The up and down motion moves the gripper 15 towards or away from the gripper seat 18. The angular or rotational movement moves the gripper bar 8 towards or away from the pivot arm 1. The pivot arm 1 further has a channel 27 in which the pin assembly 21 of the gripper bar 8 travels in.

Figure 6:
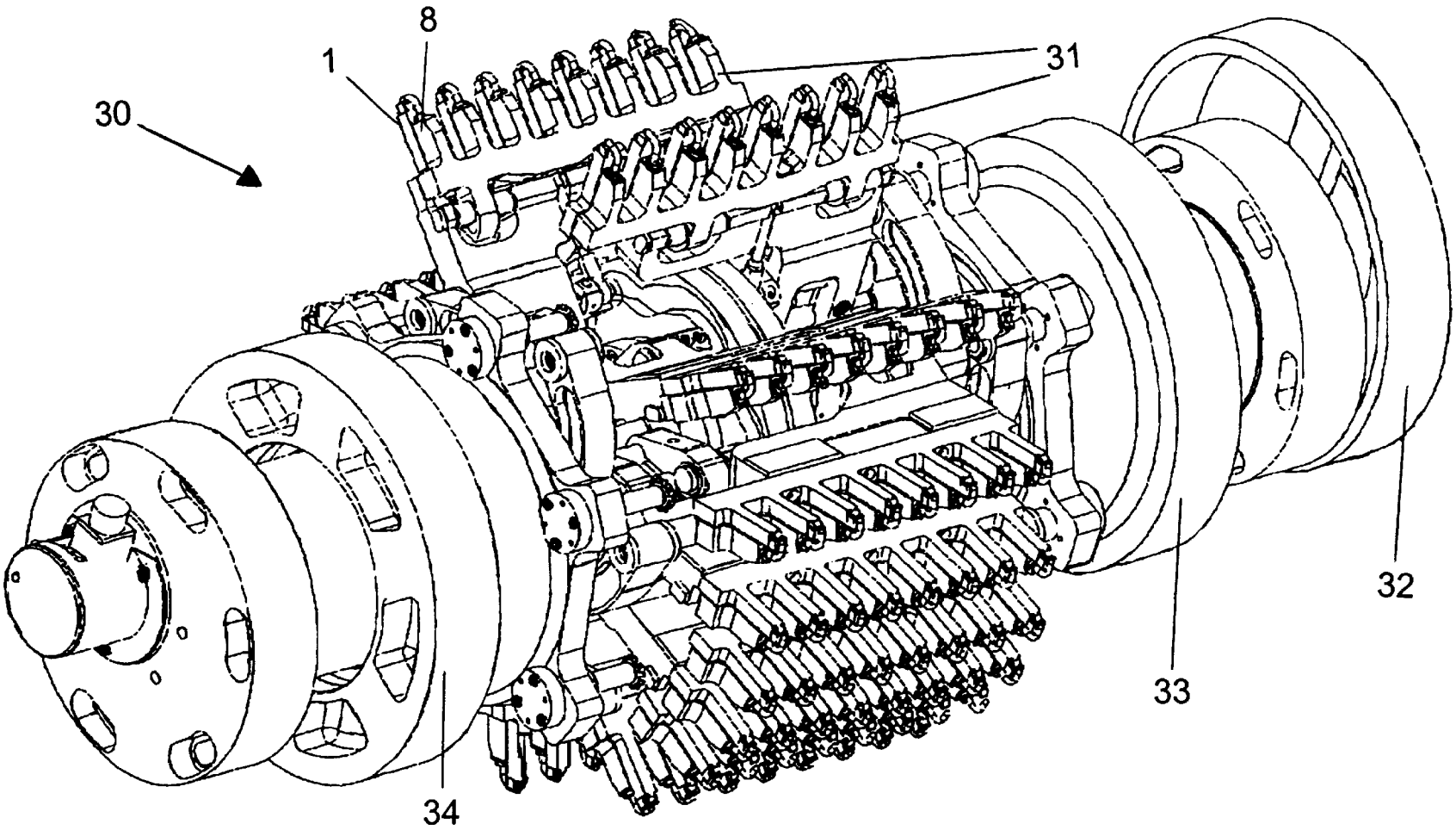
FIG. 6 is a perspective view of a matched velocity transfer device carrying a plurality of the gripper assemblies.

FIG. 6 is a perspective view of a matched velocity transfer device 30 having a plurality of the gripper assemblies 31 each containing the pivot arm 1 and the gripper bar 8. The matched velocity transfer device 30 has a first drive wheel or pulley 32, a second drive wheel or pulley 33, and a third drive wheel or pulley 34. The drive wheels 32-34 can be driven by drive belts. The matched velocity device 30 shown in FIG. 6 functions as a deceleration drum but can also be configured to function as an acceleration drum.

Figure 7:
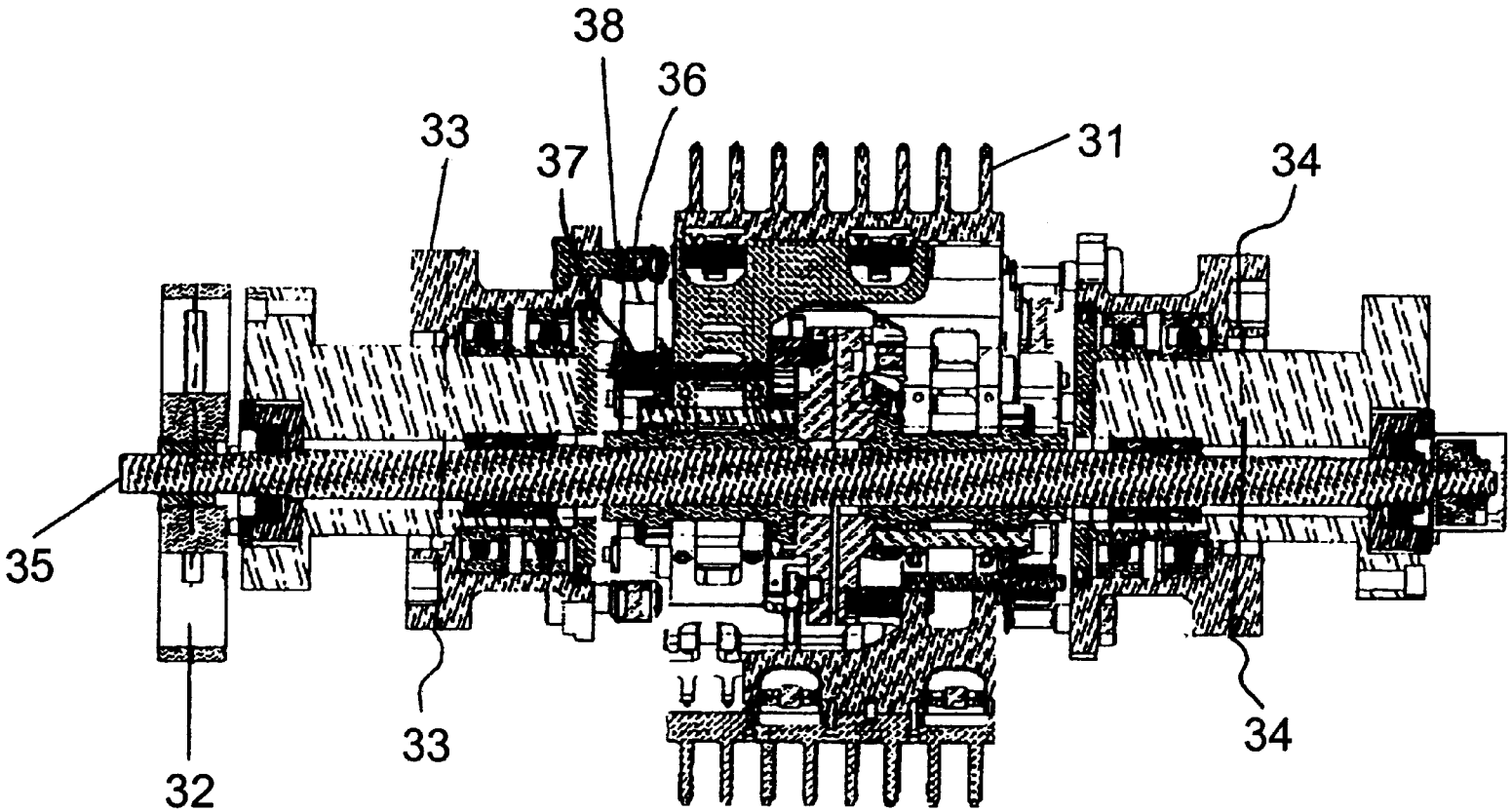
FIG. 7 is a longitudinal sectional view of the matched velocity transfer device.
Figure 8:
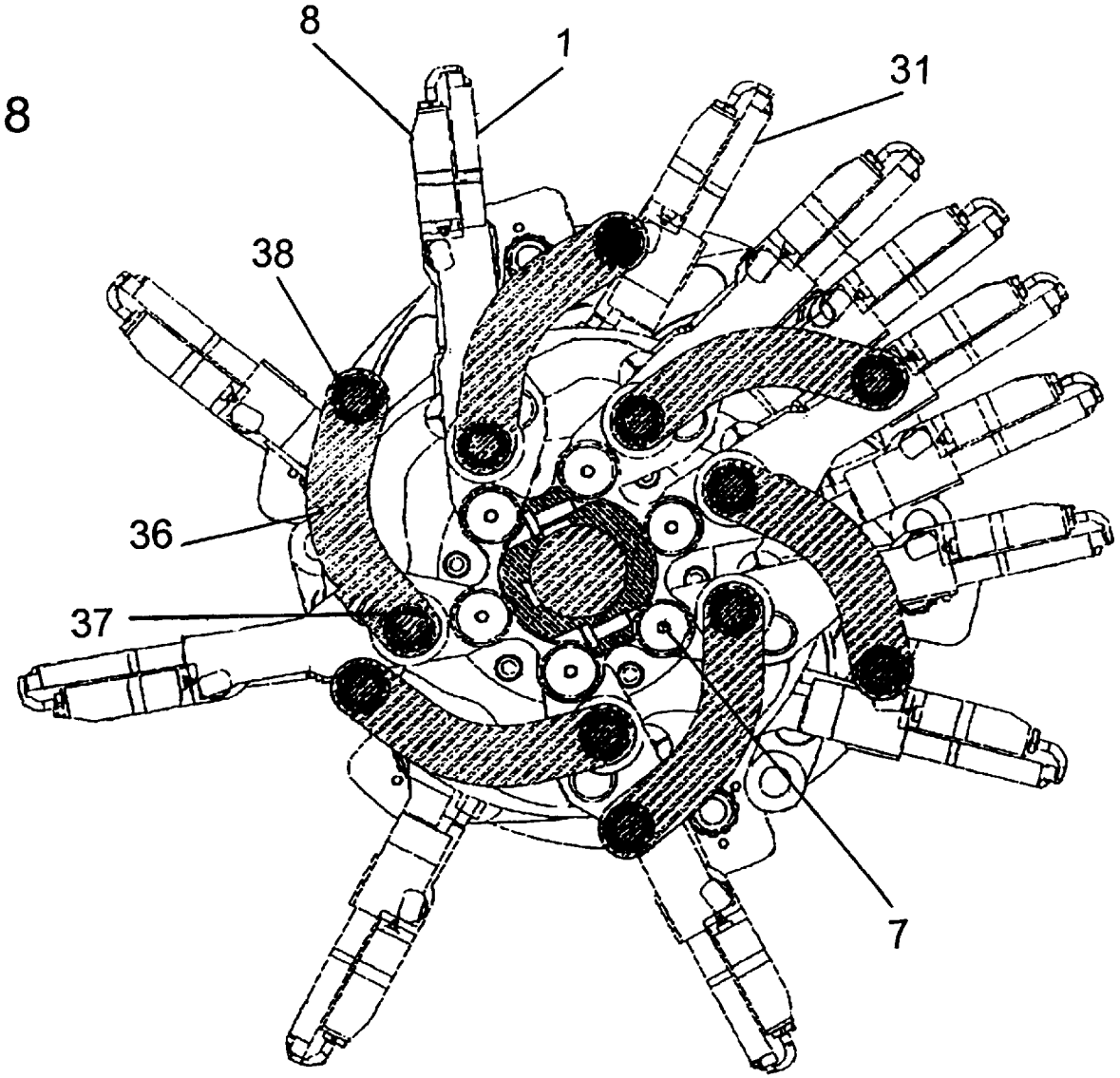
FIG. 8 is a sectional view of the matched velocity transfer device.

FIG. 7 shows a longitudinal sectional view of the matched velocity transfer device 30 and FIG. 8 shows a cross-sectional view of the matched velocity transfer device 30. The drive wheel 32 drives a shaft 35 that in turn drives the gripper assemblies 31 around the pivot points 7. The drive wheels 33, 34 each drive six of the gripper assemblies 31. The drive wheels 33, 34 drive a top part 38 of a linkage 36 that in turn drives a shaft 37 (also see FIGS. 1 and 5) for further changing a velocity of the gripper assemblies 31.

We claim:

1. A gripper assembly for a deceleration/acceleration drum, comprising:

a pivot arm having at least one gripper seat;

a gripper bar having at least one gripper and a pin assembly;

a first toggle link supported by said pivot arm about a first pivot point, said gripper bar is able to partially rotate about said first toggle link about a second pivot point;

a second toggle link supported by said pivot arm and supporting said pin assembly of said gripper bar; and a cam having a contoured path formed therein, said pin assembly extending into and guided by said contoured path, a rotation of said cam causing a movement of said pin assembly such that said gripper moves one of towards and away from said gripper seat due to the rotation of said cam, while said gripper seat is being moved such that said gripper seat is directly aligned with a leading edge of a signature and is traveling at a same velocity as the signature, said cam starts driving said gripper in a direction of said gripper seat such that the signature is eventually held between said gripper and said gripper seat without changing a velocity of the signature.

2. The gripper assembly according to claim 1, including a cam follower driving a rotation of said cam.

3. The gripper assembly according to claim 1, wherein said pin assembly through said cam moves said gripper bar in a rotational direction around said second pivot point such that said gripper bar moves one of towards and away from said pivot arm.

4. The gripper assembly according to claim 1, wherein said pin assembly is supported by said second toggle link.

5. The gripper assembly according to claim 1, wherein said first toggle link has a section in the shape of a cylinder and said gripper bar rotates about said section.

6. The gripper assembly according to claim 1, wherein said pivot arm has holes formed therein and said first toggle link has pins that are able to rotate in said holes of said pivot arm.

7. The gripper assembly according to claim 1, wherein said pivot arm has a channel formed therein receiving said pin assembly.

8. The gripper assembly according to claim 1, wherein said contoured path has an irregular sinusoidal shape.

9. The gripper assembly according to claim 1, wherein said second toggle link has a pin and said pin assembly has a hole formed therein receiving said pin of said second toggle link and said pin assembly is able to rotate about said pin.

10. A matched velocity transfer device, comprising:

a plurality of gripper assemblies each including:

a pivot arm having at leas t one gripper seat;

a gripper bar having at least one gripper and a pin assembly;

a first toggle link supported by said pivot arm about a first pivot point, said gripper bar is able to partially rotate about said first toggle link about a second pivot point; and a second toggle link supported by said pivot arm and supporting said pin assembly of said gripper bar;

a cam having a contoured path formed therein, said pin assembly extending into and guided by said contoured path, a rotation of said cam causing a movement of said pin assembly such that said gripper moves one of towards and away from said gripper seat and said gripper bar moves one of towards and away from said pivot arm due to the rotation of said cam; and drive wheels driving said plurality of gripper assemblies and said cam, said drive wheels moving a respective gripper assembly such that said gripper projects through-a space in front of a leading edge of a signature being delivered on a transport system, the respective gripper assembly moving into position such that said gripper seat is directly aligned with the leading edge of the signature and said gripper seat travels at a same velocity as the signature, said gripper moves in a direction of said gripper seat such that the signature is held between said gripper and said gripper seat such that the velocity of the signature is not changed.

* * * * *